United States Patent [19]

Fornaciari

[11] 4,161,954

[45] Jul. 24, 1979

[54] SMOKING APPARATUS

[76] Inventor: Bert F. Fornaciari, 179 Primrose, Palo Alto, Calif. 94303

[21] Appl. No.: 796,177

[22] Filed: May 12, 1977

[51] Int. Cl.[2] ..... A24F 1/14; A24F 1/26

[52] U.S. Cl. ..... 131/173; 131/180; 131/224; 131/223

[58] Field of Search ..... 131/200, 173, 178, 180, 131/182, 183, 231, 237, 223, 224, 205, 206, 215; 215/100; 206/242, 246, 249

[56] References Cited

U.S. PATENT DOCUMENTS

| | | | |
|---|---|---|---|
| 3,283,938 | 11/1966 | Vidal | 131/242 X |
| 3,805,806 | 4/1974 | Grihalva | 131/173 |
| 3,889,690 | 6/1975 | Guarnieri | 131/224 X |

FOREIGN PATENT DOCUMENTS

| | | | |
|---|---|---|---|
| 504266 | 4/1920 | France | 131/173 |

*Primary Examiner*—Stephen C. Pellegrino
*Attorney, Agent, or Firm*—Warren M. Becker

[57] ABSTRACT

A smoking apparatus comprising a pipe bowl for holding burning smoking material, means for connecting the pipe bowl to a means for containing water, means for drawing smoke from the pipe bowl through water contained in the water-containing means before it is discharged from the apparatus and valve means located in the pipe bowl, having a closed position for preventing smoking material in the pipe bowl from falling into the water-containing means and an open position for dumping the residue and ash from the smoking material burned in the pipe bowl into the water-containing means. The pipe bowl comprises a generally cylindrical interior surface. In one embodiment the valve means comprises a disk-shaped member and means connected to the disk-shaped member for rotating the disk-shaped member between its open and closed positions. In a second embodiment, the valve means comprises a slidable member, a hole in one half of the slidable member and means for sliding the slidable member between closed and open positions for selectively placing the hole relative to the pipe bowl and the interior of the water-containing means. Separate and apart from the valve means there is disclosed means for storing smoking material prior to its placement in the pipe bowl, means for attaching the storing means to the water-containing means, and means for mounting the pipe bowl within the interior of the storing means for catching spillage of smoking material from the pipe bowl when the pipe bowl is loaded.

13 Claims, 7 Drawing Figures

SMOKING APPARATUS

BACKGROUND OF THE INVENTION

The present invention relates to smoking apparatus in general and in particular to smoking apparatus for use by humans employing water or the like for cooling smoke therefrom prior to inhalation of the smoke.

Apparatus of the type which relates to the present invention, often called a water pipe or bong, typically comprises a pipe bowl for holding burning smoking material, a water container for containing water, means for connecting the pipe bowl to the water container, and a mouthpiece or pipe stem having an interior opening in communication with the interior of the water container above the level of water in the container. Coupled to the pipe bowl is a passageway. The passageway leads from the pipe bowl to a position beneath the water level in the water container.

In use, a person drawing on the mouthpiece or pipe stem lowers the air pressure in the air space above the surface of the water in the water container. The reduction in pressure created reduces the air pressure in the passageway connected to the pipe bowl. The reduction of air pressure in the passageway connected to the pipe bowl causes smoke from burning material in the pipe bowl to pass from the pipe bowl through the passageway, the water, the air space above the water in the water container and the mouthpiece or stem before exiting the apparatus. The passage of the smoke through the water cools the smoke.

To support the smoking material in the pipe bowl and to prevent its being drawn into the water container through the intermediate passageway during an inhalation, the smoking material is typically held in a basket-like member comprising one or more apertures or holes of sufficiently small size so as to prevent the loss of smoking material therethrough while, at the same time, being large enough to permit smoke to pass therethrough. Alternatively, the mouth of the passageway connecting the pipe bowl to the interior of the water-containing means may be placed in such a position so as to restrict the passage of smoking material therethrough, while permitting the passage of smoke therethrough.

After all of the smoking material in a load has been smoked, it is necessary to remove the residue and ash of the load from the pipe bowl to prepare it for another charge. In the smoking apparatus containing a removable basket or the like, the basket is removed and the contents dumped into a suitable container. In those types of apparatus which do not employ a removable basket it is generally necessary to remove the residue and ash of the smoking material from the pipe bowl by a pick or the like or by inverting the pipe bowl and dumping the residue and ash therefrom. Regardless of the type of conventional apparatus, the means and method for preparing a pipe bowl for a new charge is relatively messy and frequently results in the staining of one's hands and clothing.

The loading of prior known water pipes also has some disadvantages. To load the pipe bowl of a prior known water pipe, it is generally necessary to provide smoking material in a separate storing container or humidor. The smoking material is removed from the storing container and placed in the pipe bowl. Since most conventional pipe bowls are relatively small, the method employed for placing the smoking material in the pipe bowl involves pinching a small amount of the smoking material in the storing container between two fingers and transporting it to the pipe bowl. It has been found in the past that this procedure frequently results in a loss of smoking material from between the fingertips as the material is being transported and while it is being placed in the bowl.

Another disadvantage of loading prior known apparatus which utilizes a separate unattached container for storing smoking material is that generally both hands are required to pass the smoking apparatus and the container when two or more persons are sharing the smoking apparatus. This is frequently awkward and troublesome.

Still another disadvantage of prior known water pipes relates to the need for and use of a carburetor hole. The carburetor hole is a hole located in the wall of the water container above the water level. In use, the hole is usually kept closed until the last puff of smoke is to be removed from the pipe, more particularly, when the last puff of smoke is to be removed from the air space above the water level. At that time, with the hole uncovered, a sharp inhalation clears the bottle of smoke. The disadvantage associated with the presence of the hole is that prior inadvertent uncovering of the hole can lead to an unwanted loss of smoke from the bottle. Accordingly, it is desirable to be able to clear a water pipe of smoke without having to use a carburetor hole.

SUMMARY OF THE INVENTION

In view of the foregoing, a principal object of the present invention is a novel smoking apparatus of the type employing a water container for containing water, a pipe bowl for holding burning smoking material, means for connecting the pipe bowl to the water container and means for drawing smoke from the pipe bowl through water in the water container before it is discharged from the apparatus, which is cleaner and easier to use.

Another object of the present invention is a smoking apparatus employing a valve means in the pipe bowl for use in dumping the residue and ash of the smoking material after it is burned in the pipe bowl into the water container.

Another object of the present invention is a smoking apparatus of the type described above in which the valve means comprises a rotatable valve means which is rotatable between an open and a closed position.

Another object of the present invention is a smoking apparatus of the type described above in which the valve means is a slidable valve means having a hole located in one half thereof and which is slidable between an open and a closed position for positioning the hole relative to the pipe bowl and water container for dumping the residue and ash of smoking material burned in the pipe bowl into the water container.

Another object of the present invention is a smoking apparatus having a storing means attached to the apparatus for storing smoking material, wherein the pipe bowl is located in the interior of the storing means and the storing means is provided beneath the pipe bowl for catching the spillage of smoking material therefrom when the pipe bowl is being loaded.

Another object of the present invention is a smoking apparatus of the type described above comprising means for removably attaching the storing means and pipe bowl to a water-containing means in an air-tight manner, and means for covering the pipe bowl between uses for preventing the evaporation of moisture from smoking material contained therein.

Another object of the present invention is a smoking apparatus of the type described above that does not require a carburetor hole for evacuating the smoke from the air space above the water level in the water container. In the present invention the additional air is provided for evacuating the air space above the water level in the water container when the valve member in the pipe bowl is moved from a closed to an open position for dumping the residue therein. It is at this time that a sharp inhalation will not only assist dumping the residue, but evacuate the smoke from the air space above the water level in the water container, as previously done in water pipes using carburetor holes.

BRIEF DESCRIPTION OF THE DRAWINGS

The above and other objects, features and advantages of the present invention will become apparent from the following detailed description of the accompanying drawings in which.

DETAILED DESCRIPTION

Figure 1:
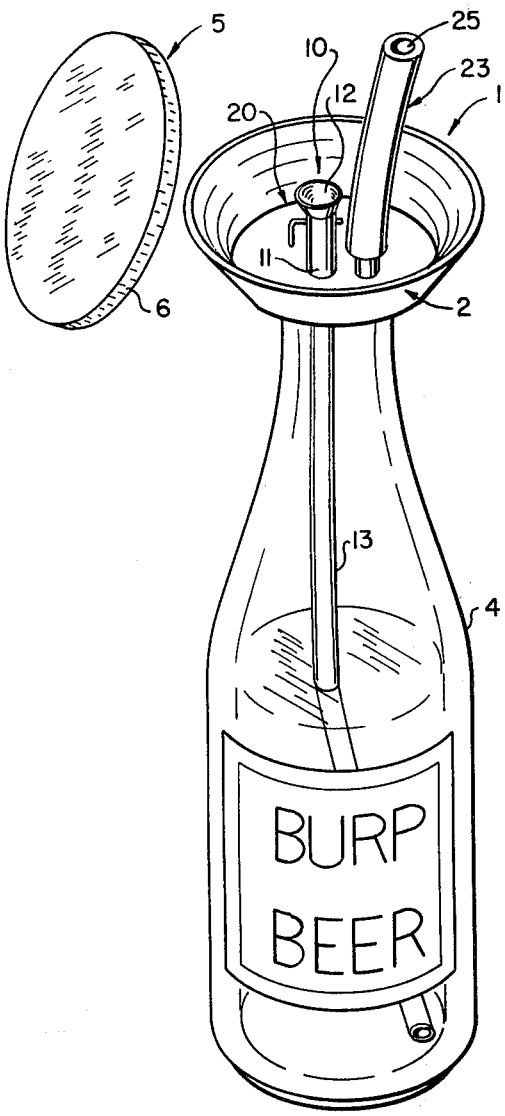
FIG. 1 is a perspective view of a smoking apparatus according to the present invention.
Figure 2:
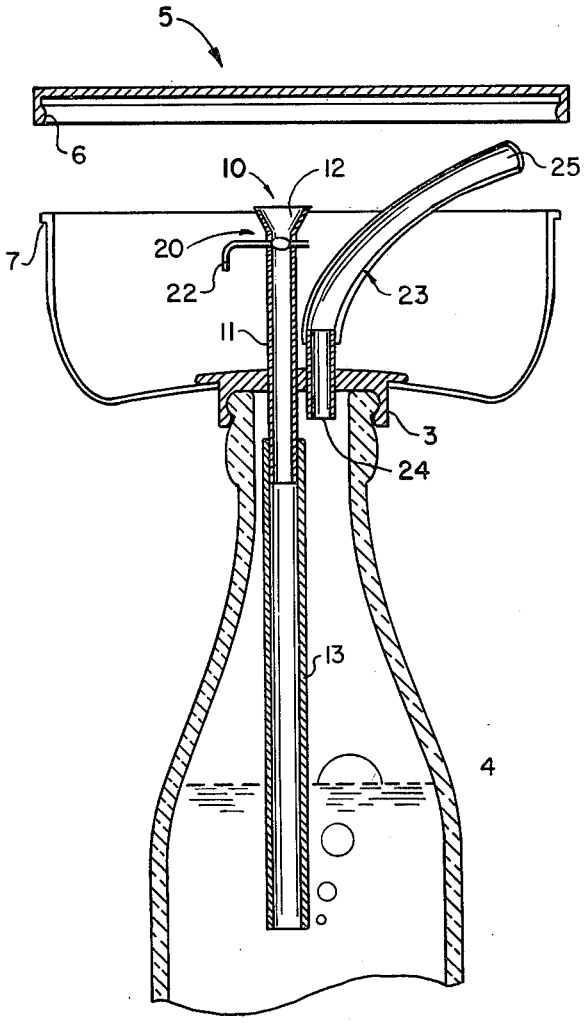
FIG. 2 is a cross-sectional view taken along lines 2—2 of FIG. 1.

Referring to FIGS. 1, 2, 3 and 4, there is provided, in accordance with the present invention, a smoking apparatus designated generally as 1. In the apparatus 1 there is provided a bowl-shaped storing means 2. The storing means 2 is provided for storing smoking material prior to its placement in a pipe bowl and may be made from a variety of materials including plastic. At the bottom of the storing means 2 there is provided an annular attaching member 3. The attaching member 3 is provided for removably attaching or sealing the storing means 2 to the mouth of a conventional beverage bottle or the like 4 in an air-tight manner. For this purpose, the interior surfaces of the attaching member 3 generally conform to the facing surfaces of the bottle 4 but have a somewhat smaller interior diameter so as to provide the described sealing function.

To close or cover the storing member 2, there is provided a cover 5. About the periphery of the cover 5 there is provided a sealing member 6. The sealing member 6 is provided to engage a corresponding member 7 at the top of the storage member 2 for providing an air-tight seal when the cover 5 is employed for covering the member 2. The cover 5 may be made of the same material as the storing means 2.

Referring to the center of the storing means 2, there is provided a pipe bowl designated generally as 10. The pipe bowl 10 comprises a generally cylindrical member 11. The member 11, at its upper or external end, is flared for forming a mouth 12. The position of the mouth 12 realtive to the elevation of the sides of the storing means 2 is such that, when the cover 5 is placed on the storage means 2 in an air-tight sealing relationship, the mouth 12 is covered by and sealed against the interior of the cover 5. As will be apparent, this prevents the entrance of air into the storing means 2 through the pipe bowl 10 when the apparatus 1 is removed from the bottle 4.

Removably attached to the lower end of the member 11 of the pipe bowl 10 there is provided a tubular member 13. To attach the member 13 to the pipe bowl 10, the lower end of the member 11 extends a suitable distance beneath the bottom surface of the storing means 2 so that the member 13 can be slipped over the exposed portion thereof in a friction-tight manner. The length of the tubular member 13 depends on the length of the bottle 4, but, in any event, is of a length sufficient to place its lower end beneath the surface of the water in the bottle.

Figure 3:
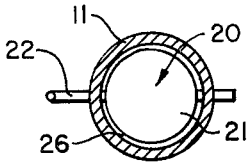
FIG. 3 is a plan view of a first embodiment of a pipe bowl with a valve means according to the present invention, with the valve means in a closed position.
Figure 4:
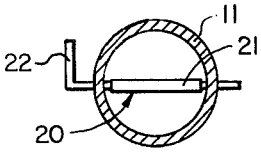
FIG. 4 is a view of the valve means of FIG. 3 with the valve means in an open position.

Referring to the interior of the pipe bowl 10, there is provided a valve means designated generally as 20. The valve means 20 comprises a rotatable disk member 21. The disk member 21 is connected to a valve handle 22. The valve handle 22 is provided for rotating the disk member 21 between a closed position as shown in FIG. 3 and an open position as shown in FIG. 4. To permit puffing the pipe bowl when the valve means is closed, there is provided, between the member 21 and the interior wall of the member 11, an air passageway 26. Additional small holes may be put in the body of the disk member if desired so long as they do not lose smoking material.

To the right of the pipe bowl 10 there is provided a second tubular member 23. The tubular member 23 has an interior end 24 and an exterior end 25. The interior end 24 is provided to open into the water-containing means 4. The length of the tubular member 23 is such that the end 25 can be placed in a person's mouth and serves as a mouthpiece or pipe stem. It is, of course, possible to also employ an additional removable mouthpiece (not shown) and insert the same into the end 25 if desired when more than one person is using the apparatus.

In use, the apparatus 1 is removably mounted to the top of a bottle 4. The bottle 4 may be, for example, a conventional soft drink or small-mouthed beer bottle, and is provided to contain three to five ounces of water. The bottle is then grasped beneath the storing means 2. This is very convenient and easily permits holding the bottle securely between two fingers. With the cover 5 removed from the storing means 2, a pinch of smoking material stored within the storing means 2 is placed into the pipe bowl 10 with the valve means 20 in its closed position, as shown in FIG. 3. If any smoking material spills, it falls into the storing means 2 and is not lost. The smoking material is then ignited with a match or the like while the user inhales or otherwise sucks air from the tubular member 23. The sucking of air from the tubular member 23 reduces the air pressure in the interior of the bottle 4, causing a reduction of air pressure in the tubular member 13. A reduction of the air pressure in the tubular member 13 causes smoke from the burning smoking material in the pipe 10 to be drawn downwardly past the disk member 21, through the tubular member 13 and into the water in the bottom of the bottle 4, and thence upwardly and through the tubular member 23. The passage of air through the pipe bowl 10 is made possible by the allowance of the air space 26 between the periphery of the disk member 21 and the interior wall surface of the member 11. It will be appreciated, as indicated above, that, if desired, additional smoking holes may be provided in the body of the disk member 21 so long as the size of the holes does not permit the passage of smoking material therethrough or the clogging thereof.

After all of the smoking material in the pipe bowl 10 has been burned and it is desired to empty the pipe bowl to recharge it, the disk-shaped member 21 is rotated by means of the handle 22 from its closed position, as shown in FIG. 3, to its open position, as shown in FIG. 4. When the valve member 21 has been placed in its open position, a sharp inhalation or sucking will cause the residue and ash from the burning smoking material to be sucked downwardly through the tubular member 13 and into the water in the bottom of the water bowl 4. After the pipe bowl has thus been emptied, the disk member 21 can be returned to its closed position and the pipe bowl 10 recharged with smoking material from the storing means 2.

Figure 7:
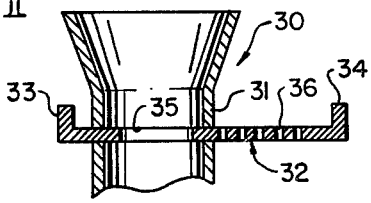
FIG. 7 is a cross-sectional view of the valve means of FIG. 5 in a closed position.
Figure 6:
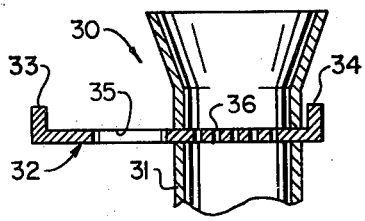
FIG. 6 is a cross-sectional view of the valve means of FIG. 5 in an open position.
Figure 5:
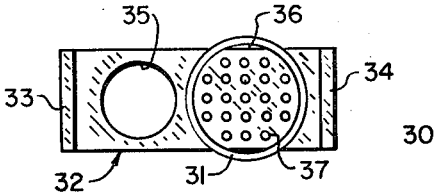
FIG. 5 is a plan view of a second embodiment of a pipe bowl with a valve means according to the present invention.

Referring to FIGS. 5, 6 and 7, there is provided, in an alternative embodiment of the present invention, a pipe bowl 30. The pipe bowl 30 comprises a generally cylindrical member 31 which, like the bowl 10 of FIGS. 1–4, is rigidly mounted in the bottom of a storing means such as the storing means 2 of FIG. 1. Slidably mounted in the cylindrical member 31 there is provided a slidable member 32. At the left end of member 32 there is an upstanding member 33. At the right end of the member 32 there is another upstanding member 34. In the left half of member 32 there is provided a hole 35. In the right half of the member 32 there is provided, relative to the interior walls of the member 31, a plurality of holes 36 and 37. The holes 36 and 37 are provided for providing an air passageway for the passage of smoke past the sliding valve member 32 when, as shown in FIG. 5, the valve member 32 is closed.

In use, smoking material is placed in the upper portion of the pipe bowl 30 with the valve member 32 in its closed position, as shown in FIGS. 5 and 7. Sliding member 32 is placed in its closed position by grasping the upstanding member 33 as by a fingernail or by pushing against the member 34 and moving the member 32 to the left, as shown in FIGS. 5 and 7. After the smoking material has been burned and it is desired to empty the pipe bowl 30, the upstanding members 34 or 31 are engaged as by a fingernail and pulled or pushed, respectively, to move the sliding member 32 to the right, as shown in FIG. 6. With the member 32 in its open position, as shown in FIG. 6, a sharp inhalation or sucking, as described above with respect to the emptying of the pipe bowl 10, will cause the residue and ash to be sucked from the bowl 30 through the hole 35.

Between uses, the apparatus 1 may be left attached to the bottle 4 or removed from the bottle. With the apparatus left attached to the bottle 4, the tubular member 23 is simply folded into the storing means 2 and the cover 5 replaced thereon. With the member 23 sealed within the storing means 2, all outside or external air passageways are sealed. This prevents, or at least reduces the rate of evaporation of moisture from smoking material with the storing means. Also, because a passageway exists between the water in the container 4 and the interior of the storing means 2 through the tubular member 23, water vapor from the water in the container 4 may pass through the member 23 into the storing means 2. This will aid in keeping the smoking material from drying out, as in conventional humidors.

If the apparatus 1 is removed from its water container 4 between uses, as is convenient when transporting the apparatus in a suitcase, for example, the tubular member 13 is removed from the extension of the member 11 of the pipe bowl 10. and stored in the storing means 2. Then, as described above, the tubular member 23 is folded into the storing means 2. However, because outside air can enter the storing means 2 through the tubular member 23 when the apparatus is removed from the container 4, the member 23 is folded in a manner to seal or otherwise block its internal passageway before the cover 5 is put in place. Alternatively, a clip or the like may be used to perform the sealing function. In all cases, no unpleasant odors can escape from the apparatus and the freshness of smoking material contained therein is preserved between uses once its parts are secured within the storing means 2 and the cover 5 replaced thereon.

A novel, more convenient and easily used embodiment of a water pipe is described, and a number of alternative embodiments are suggested. It is contemplated that still other changes will occur to those skilled in the art which can be made without departing from the spirit and scope thereof. Accordingly, it is intended that the scope of the invention be not limited to the embodiments described and suggested, but rather that it be determined by reference to the claims hereafter provided and their equivalents.

What is claimed is:

1. In a smoking apparatus having a water container for containing water, a pipe bowl for holding burning smoking material, means for connecting said pipe bowl to the water container and means for drawing smoke from the pipe bowl through water in the water container before it is discharged from the apparatus, the improvement comprising:

valve means located in the pipe bowl having a closed position for preventing smoking material in the pipe bowl from falling into the water container and an open position for dumping the residue and ash from smoking material burned in the pipe bowl into the water container, said valve means including an air passageway for permitting smoke to pass therethrough when said valve means is in its closed position.

2. An improvement according to claim 1 wherein said air passageway between the interior of the pipe bowl and the interior of the water container comprises a space betwen the periphery of the valve means and the interior of the pipe bowl when the valve means is in said closed position.

3. An improvement according to claim 2 wherein said valve means comprises a rotatable member which is rotatable between said open and said closed positions in the pipe bowl.

4. An improvement according to claim 2 wherein the pipe bowl has a generally cylindrical interior surface and the valve means comprises a disk-shaped member, and further comprising means connected to the disk-shaped member which extends through the wall of the pipe bowl for rotating the disk-shaped member between said open and said closed positions.

5. An improvement according to claim 1 wherein said valve means comprises:

a slidable member slidably mounted in said pipe bowl, said slidable member being slidable between said open and said closed positions in said pipe bowl;

means for sliding said slidable member between said open and said closed positions; and a hole located in said slidable member for allowing the passage of said residue and ash therethrough when said slidable member is moved to said open positions and said hole is located between said pipe bowl and the interior of said water container.

6. An improvement according to claim 1 comprising:

means forming a container for storing smoking material prior to the placing of the smoking material in the pipe bowl;

means for attaching the storing means to the water container; and means for covering the storing means for preventing the drying out of smoking material stored therein.

7. An improvement according to claim 6 wherein the pipe bowl is located interior of the walls of the storing means, and said means for drawing smoke from the pipe bowl through the water container before it is discharged from the apparatus comprises a hollow tubular member forming a mouthpiece which has an interior portion which extends into the interior of the water container and an exterior portion which is placeable in a person's mouth for inhaling smoke from the water container, and wherein said exterior portion, when not in use, is placeable within the interior walls of the storing means so that it and the pipe bowl can be covered and sealed within said storing means when said covering means is placed on said storing means for allowing water vapor from the water in said water container to enter the storing means and moisten smoking material stored therein while preventing the entry of outside air therein.

8. In a smoking apparatus having a water container, a pipe bowl and means including a mouthpiece connected to the pipe bowl for drawing smoke from the pipe bowl through water in the water container before it is inhaled, the improvement comprising:

means forming a storing container for storing smoking material before its palcement in the pipe bowl;

means for mounting said storing means on said water container with said pipe bowl being located interior of the walls thereof so that any spillage of smoking material from the pipe bowl during loading of the smoking material in the pipe bowl is not lost but falls into the storing means; and means for covering the storing means in an air-tight manner when the apparatus is not in use for preventing the evaporation of moisture from smoking material stored in the storing means, said mouthpiece comprising a flexible tubular member having an interior portion which extends into the interior of said water container through a wall of the storing means, and an exterior portion which, during use, is placeable in a person's mouth, and, between uses, can be placed within said storing means and covered in an air-tight manner with said covering means so that moisture from said water container can enter the storing means through said mouthpiece and moisten smoking material stored therein.

9. An apparatus according to claim 8 wherein said means for mounting said storing means on said water container comprises means for mounting said storing means and pipe bowl on a conventional container used for containing liquid beverages.

10. An apparatus according to claim 9 wherein said conventional container is a conventional bottle for containing liquid beverages.

11. An improvement according to claim 8 wherein said covering means comprises means for covering said pipe bowl within said storing means in an air-tight manner.

12. A pipe bowl and valve assembly for a smoking apparatus comprising:

means forming a pipe bowl for containing smoking material, said pipe bowl having an opening therein for the passage of smoke therefrom;

valve means located in said pipe bowl having a closed position for preventing the contents of the pipe bowl from falling from the pipe bowl through said opening in said pipe bowl, and an open position for permitting the contents of the pipe bowl to pass from the pipe bowl through said opening in said pipe bowl, said pipe bowl and valve means including means for permitting the passage of smoke therefrom through said opening in said pipe bowl when said valve means is in its closed position; and means for attaching said pipe bowl and valve means to said smoking apparatus.

13. An assembly according to claim 12 wherein said attaching means comprises means for attaching said pipe bowl and valve means to a container for containing water in said smoking apparatus.

* * * * *